US010808340B2

(12) United States Patent
Wheatley

(10) Patent No.: US 10,808,340 B2
(45) Date of Patent: Oct. 20, 2020

(54) WOVEN FIBER REINFORCEMENT MATERIAL

(71) Applicant: Fortress Stabilization Systems, Dexter, MI (US)

(72) Inventor: Donald E. Wheatley, Ann Arbor, MI (US)

(73) Assignee: Fortress Stabilization Systems, Holland, MI (US)

( * ) Notice: Subject to any disclaimer, the term of this patent is extended or adjusted under 35 U.S.C. 154(b) by 0 days.

(21) Appl. No.: 13/739,070

(22) Filed: Jan. 11, 2013

(65) Prior Publication Data

US 2013/0117979 A1 May 16, 2013

Related U.S. Application Data

(63) Continuation of application No. 12/212,110, filed on Sep. 17, 2008, now abandoned.
(Continued)

(51) Int. Cl.
*D04B 1/14* (2006.01)
*D06B 1/00* (2006.01)
(Continued)

(52) U.S. Cl.
CPC ..... *D04B 1/14* (2013.01); *D03D 9/00* (2013.01); *D03D 13/004* (2013.01);
(Continued)

(58) Field of Classification Search
USPC ..... 442/58–59, 179–180, 60, 189, 199, 203, 442/217, 220
See application file for complete search history.

(56) References Cited

U.S. PATENT DOCUMENTS 2,898,258 A 8/1959 Meier et al.
3,239,403 A 3/1966 Williams
(Continued)

FOREIGN PATENT DOCUMENTS

JP 09-003745 A 1/1997
JP 09-057882 A 3/1997
(Continued)

OTHER PUBLICATIONS

ACI Structural Journal, Technical Paper, Title No. 91-S17, Mar.-Apr. 1994, "Strengthening of Initially Loaded Reinforced Concrete Beams Using FRP Plates," by Alfarabi Shari, G.J. Al-Sulaimani, I.A. Basunbuil, M.H. Baluch, and B.N. Ghaleb.
(Continued)

*Primary Examiner* — Jennifer A Chriss
*Assistant Examiner* — Ricardo E Lopez
(74) *Attorney, Agent, or Firm* — Harness, Dickey & Pierce, P.L.C.

(57) ABSTRACT

A woven fiber reinforcement material and method of making includes a plurality of fiber bundles extending generally parallel to one another in a longitudinal direction and spaced laterally from one another by at least 1/32 of an inch. The fiber bundles are selected from non-elastic fibers. A first transverse thread extends in a continuous serpentine pattern on a first side of the plurality of fiber bundles. A second transverse thread extends in a continuous serpentine pattern on a second side of the plurality of fiber bundles and a pair of connecting threads diagonally cross the first and second transverse threads and secure the first and second transverse threads to the fiber bundles at a plurality of longitudinally spaced locations.

2 Claims, 2 Drawing Sheets

Related U.S. Application Data

(60) Provisional application No. 60/973,866, filed on Sep. 20, 2007.

(51) Int. Cl.

| | |
|---|---|
| ***D03D 15/00*** | (2006.01) |
| ***D03D 17/00*** | (2006.01) |
| ***D03D 9/00*** | (2006.01) |
| ***D03D 13/00*** | (2006.01) |

(52) U.S. Cl.

CPC ..... *D03D 13/006* (2013.01); *D03D 15/00* (2013.01); *D03D 17/00* (2013.01); *D06B 1/00* (2013.01); *D10B 2101/12* (2013.01); *D10B 2201/02* (2013.01); *D10B 2321/022* (2013.01); *D10B 2331/02* (2013.01); *D10B 2331/021* (2013.01); *D10B 2331/04* (2013.01); *D10B 2505/02* (2013.01); *Y10T 442/2361* (2015.04); *Y10T 442/30* (2015.04)

(56) References Cited

U.S. PATENT DOCUMENTS

| | | | | |
|---|---|---|---|---|
| 3,344,608 | A | 10/1967 | McEachran | |
| 4,113,401 | A | 9/1978 | McDonald | |
| 4,233,356 | A | 11/1980 | Jacobs | |
| 4,242,779 | A | 1/1981 | Curinier et al. | |
| 4,265,563 | A | 5/1981 | Marzocchi et al. | |
| 4,472,086 | A | 9/1984 | Leach | |
| 4,540,311 | A | 9/1985 | Leach | |
| 4,551,994 | A | 11/1985 | Vailati et al. | |
| 4,631,932 | A | 12/1986 | Sommers | |
| 4,786,341 | A | 11/1988 | Kobatake et al. | |
| 4,786,549 | A | 11/1988 | Richards | |
| 4,916,874 | A | 4/1990 | McCoy et al. | |
| 5,026,609 | A | 6/1991 | Jacob et al. | |
| 5,246,306 | A | 9/1993 | Shoesmith et al. | |
| 5,464,304 | A | 11/1995 | Dittmar | |
| 5,607,527 | A * | 3/1997 | Isley, Jr. | E04C 3/34 156/71 |
| 5,630,677 | A | 5/1997 | Barroso | |
| 5,635,263 | A | 6/1997 | Saito | |
| 5,640,825 | A | 6/1997 | Ehsani et al. | |
| 5,649,398 | A | 7/1997 | Isley, Jr. et al. | |
| 5,763,043 | A * | 6/1998 | Porter | D03D 9/00 428/109 |
| 5,836,715 | A * | 11/1998 | Hendrix et al. | 404/134 |
| 5,845,450 | A | 12/1998 | Larsen | |
| 5,868,399 | A | 2/1999 | Schluter | |
| 5,882,749 | A | 3/1999 | Jones et al. | |
| 5,894,003 | A | 4/1999 | Lockwood | |
| 5,941,656 | A | 8/1999 | Sugiyama et al. | |
| 6,004,888 | A | 12/1999 | Sugimoto et al. | |
| 6,052,960 | A | 4/2000 | Yonemura | |
| 6,056,479 | A * | 5/2000 | Stevenson et al. | 405/302.7 |
| 6,145,260 | A | 11/2000 | Morton | |
| 6,263,629 | B1 * | 7/2001 | Brown, Jr. | 52/309.16 |
| 6,418,684 | B1 | 7/2002 | Morton | |
| 6,450,729 | B1 | 9/2002 | Clapp | |
| 6,627,290 | B2 | 9/2003 | Wittlinger et al. | |
| 6,648,547 | B2 | 11/2003 | Jones et al. | |
| 6,682,260 | B2 | 1/2004 | Peltz | |
| 6,692,595 | B2 | 2/2004 | Wheatley et al. | |
| 6,694,690 | B2 | 2/2004 | Li et al. | |
| 6,696,125 | B2 | 2/2004 | Zanchetta et al. | |
| 6,746,741 | B2 | 6/2004 | Wheatley | |
| 6,846,537 | B2 | 1/2005 | Wheatley et al. | |
| 7,048,880 | B2 | 5/2006 | Kia et al. | |
| 7,232,276 | B2 | 6/2007 | Oka et al. | |
| RE39,839 | E | 9/2007 | Wheatley et al. | |
| 7,597,503 | B2 | 10/2009 | Hinding et al. | |
| 2004/0025465 | A1 | 2/2004 | Aldea et al. | |
| 2004/0194424 | A1 | 10/2004 | Frost et al. | |
| 2005/0011576 | A1 * | 1/2005 | Dini | D03D 41/00 139/20 |
| 2005/0241260 | A1 | 11/2005 | Wheatley | |
| 2006/0059827 | A1 | 3/2006 | Wheatley | |
| 2007/0272353 | A1 | 11/2007 | Wheatley et al. | |
| 2009/0071085 | A1 | 3/2009 | Wheatley et al. | |
| 2009/0081913 | A1 | 3/2009 | Wheatley | |
| 2009/0214293 | A1 | 8/2009 | Wheatley | |
| 2009/0263572 | A1 | 10/2009 | Wheatley | |

FOREIGN PATENT DOCUMENTS

| | | | |
|---|---|---|---|
| JP | 10-033053 | A | 2/1998 |
| JP | 10-037051 | A | 2/1998 |
| JP | 2000265141 | | 9/2000 |
| JP | 2002-155509 | A | 5/2002 |

OTHER PUBLICATIONS

ACI Structural Journal, Technical Paper, Title No. 91-S34, May-Jun. 1994, "Fiber Composites for New and Existing by Hamid Saadatmanesh Structure," by Hamid Saadatmanesh.

Coatings for Safety, Procedures for better coatings may help prevent black ice. Concrete Surfaces Magazine (Dec. 1, 2007). http://www.concreteconstruction.net/industry-news.asp?sectionID=718&articleID=634984 (2 pages).

* cited by examiner

WOVEN FIBER REINFORCEMENT MATERIAL

CROSS-REFERENCE TO RELATED APPLICATIONS

This application is a continuation of U.S. patent application Ser. No. 12/212,110, filed on Sep. 17, 2008, which claims the benefit of U.S. Provisional Application No. 60/973,866, filed on Sep. 20, 2007. The entire disclosures of the above applications are incorporated herein by reference.

FIELD

The present disclosure relates to a woven fiber reinforcement material and more particularly, to a weave pattern of a fiber reinforcement material and method of making.

BACKGROUND

The statements in this section merely provide background information related to the present disclosure and may not constitute prior art.

This disclosure relates to a product for use in reinforcing structures and a method for attaching the product to the structure and in particular to reinforce concrete walls and other concrete structures using carbon fiber material with epoxy adhered to the carbon fiber material. The invention further includes a rigidified mesh of carbon fiber material designed for adherence to a structural element. Walls constructed of concrete blocks are well known in the field of construction and have been extensively used for both above ground and basement walls. Such concrete walls constructed in this manner are generally capable of supporting residential and light commercial structures and are relatively inexpensive to manufacture and repair.

Applicant's co-pending U.S. patent application Ser. No. 11/754,144, filed May 25, 2007 entitled "Method and Apparatus for Sealing Seams in Segmented Bridges," is herein incorporated by reference and discloses a reinforcement technique employed for bridge structures.

In order to construct a concrete wall, individual blocks are laid end to end and successive rows or courses are stacked thereon. Mortar between each adjacent block and row secures the wall together. These walls are such that they have excellent compressive strength to support structures placed upon them. However, these walls are inherently weak with respect to lateral loads and are particularly susceptible to cracking from water pressure. This inherent weakness of concrete walls is attributable to the structural characteristics of the concrete walls themselves and the mortar joints at which they are connected. Walls constructed in this manner are relatively strong in compression and are thus well suited for supporting overlying structures. However, both the concrete material and particularly the mortar joints are weak in tension, and when subjected to a tensile force, they tend to separate relatively easily.

Water penetrating deeply into the soil adjacent a basement wall can cause substantial lateral movement of the expanding soil against the wall. Over a period of time, block or concrete walls develop diagonal cracks at the ends and vertical cracks near their centers. Such cracks can admit water under pressure from the surrounding soil and, if left untreated, can progressively widen and eventually facilitate collapse of the entire structure with resultant damage to the structure supported on it. In addition to developing such cracks, concrete walls typically either bow inwardly and such bowing or tilting steadily worsens with the weight of the overlying structure. The water pressure exerts a compressive force at the outer end, therefore, basement wall cracks tend to develop on the inside of such walls.

One of the traditional methods of repairing the leaks and cracks and relieving the external pressure is to drill holes and provide for channeling of the water away on the inside. Yet another method for repairing cracks and leaks is to inject an epoxy resin into the cracks. Although these methods will prevent further water from entering the cracks they do not bind the concrete walls and prevent further cracking or bowing of the concrete walls.

Yet another means of correcting the cracks in the walls is to use fiberglass cloth with epoxy or polyester resin. Fiberglass has good tensile properties and can carry the load on the interior of the basement walls that is in tension. However, one of the major drawbacks with this method is that mixing the epoxy or polyester and wetting out the fabric is time consuming and messy.

In recent years, technology has developed whereby the concrete walls are reinforced using precut strips of carbon fiber. This prevents the walls from cracking or collapsing. However, precut carbon fiber strips have to be cleaned and roughened, commonly done through sanding, to provide mechanical adhesion with the walls. The sanding process is not only time consuming, but is completely dependent on the skill of the operator sanding the surface of the strip. Sanding also may not remove oil or waxy materials and may spread such contaminants with a detrimental affect on bonding. This results in extra cost in transporting and storing the precut strips. Applicant's U.S. Pat. No. 6,692,595 is herein incorporated by reference and provides a rigidified reinforcement material using a woven carbon and nylon strands coated with a cured resin material and with a removable backing material to leave a textured or roughened surface to enhance mechanical adhesion. The rigidified reinforcement material is expensive to manufacture in long strips as is required in some reinforcement applications.

SUMMARY

A woven fiber reinforcement material includes a plurality of fiber bundles extending generally parallel to one another in a longitudinal direction and spaced laterally from one another by at least 1/32 of an inch. The fiber bundles are selected from non-elastic fibers. A first transverse thread extends in a continuous serpentine pattern on a first side of the plurality of fiber bundles. A second transverse thread extends in a continuous serpentine pattern on a second side of the plurality of fiber bundles and a pair of connecting threads diagonally cross the first and second transverse threads and secure the first and second transverse threads to the fiber bundles at a plurality of longitudinally spaced locations.

DRAWINGS

The drawings described herein are for illustration purposes only and are not intended to limit the scope of the present disclosure in any way.

DETAILED DESCRIPTION

Figure 1:
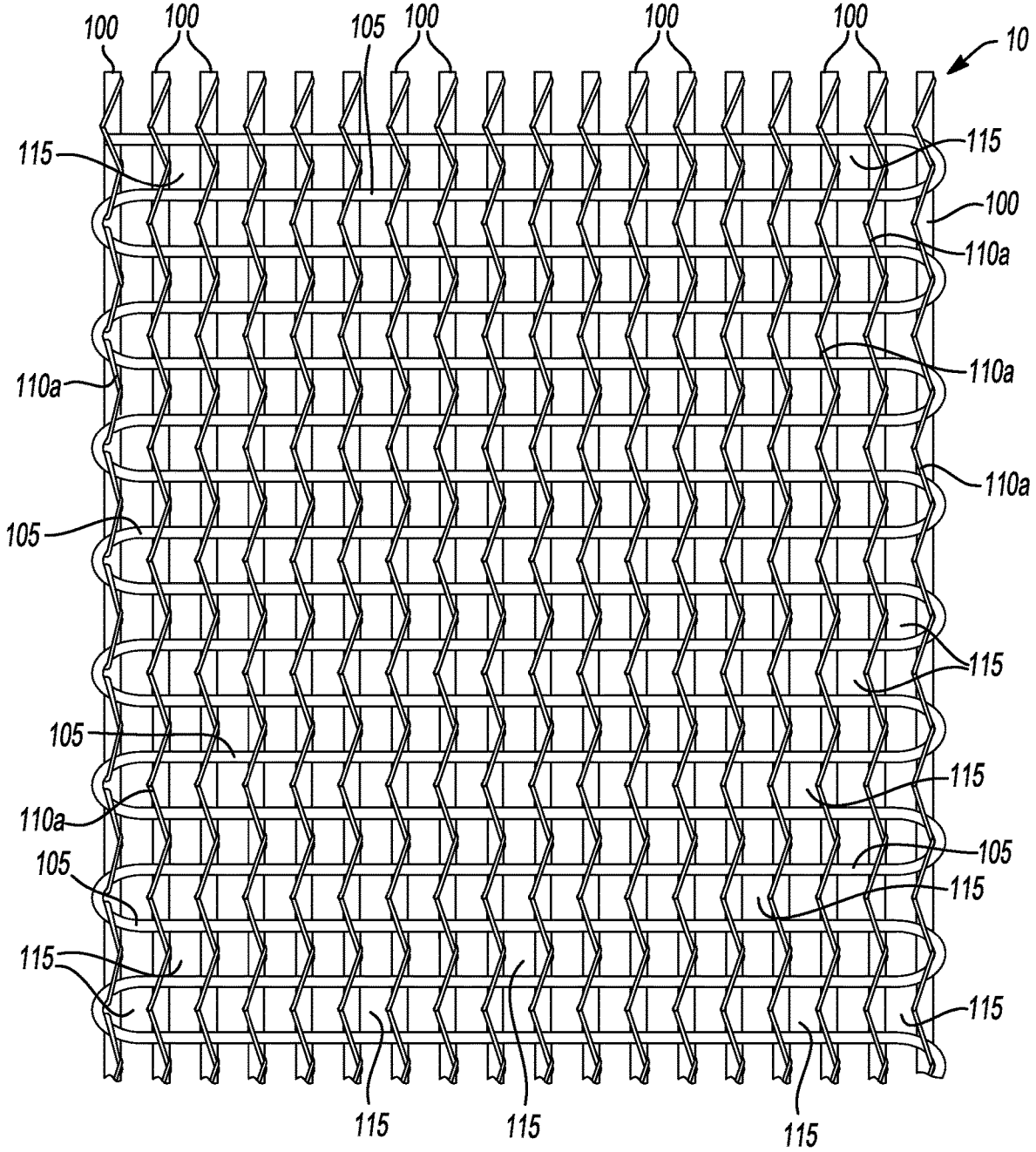
FIG. 1 is a plan view of a carbon fiber bundle reinforcement material according to the present disclosure.

The following description is merely exemplary in nature and is not intended to limit the present disclosure, application, or uses. It should be understood that throughout the drawings, corresponding reference numerals indicate like or corresponding parts and features.

Figure 3A:
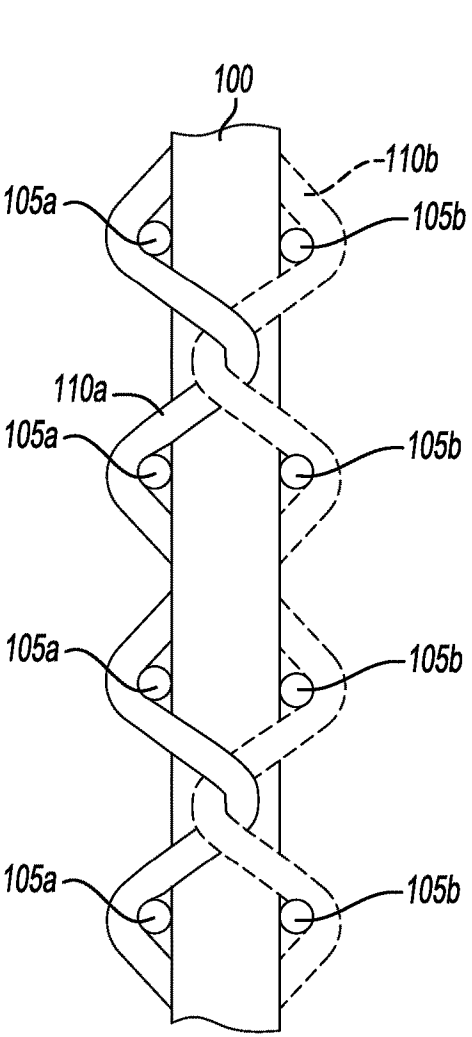
FIGS. 3 and 3A are cross-sectional views taken along line 3-3 of FIG. 2, illustrating the weave used in making a carbon fiber bundle reinforcement material according to some embodiments of the present disclosure.
Figure 3:
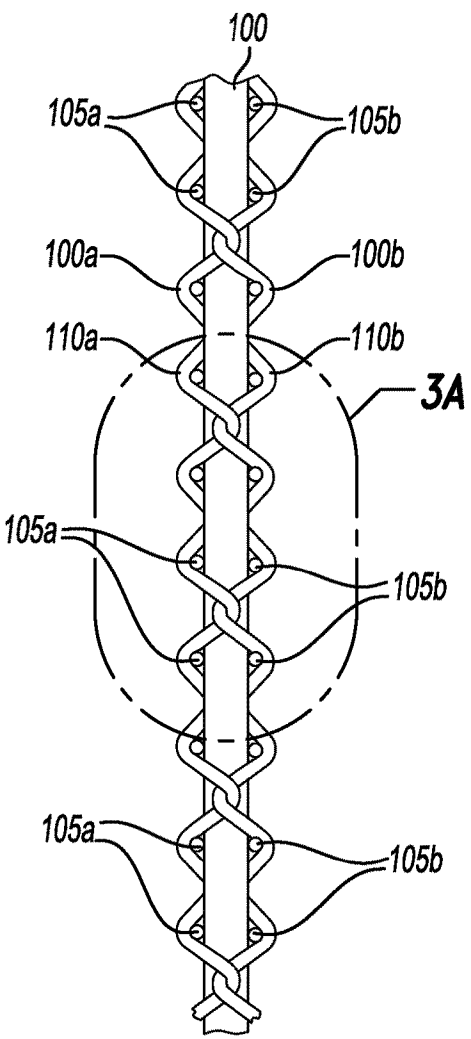
Figure 2:
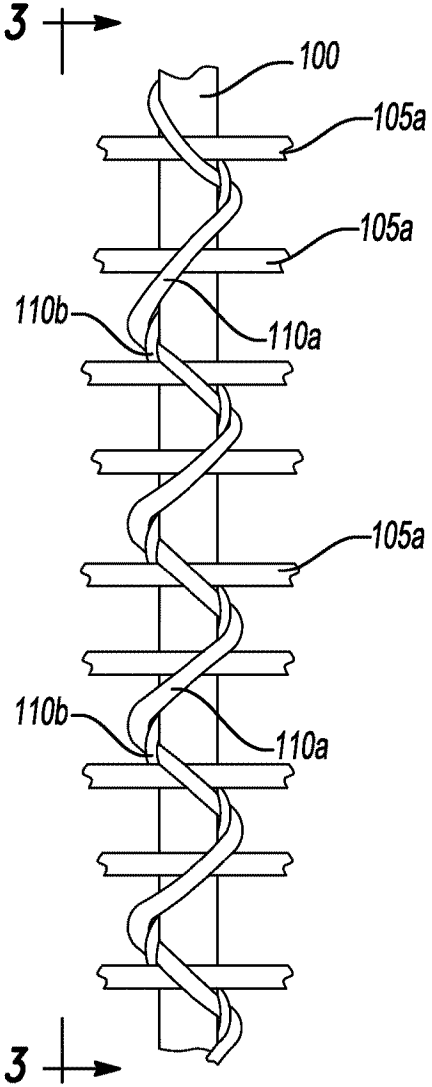
FIG. 2 is an illustration of a weave used in making a carbon fiber bundle reinforcement material according to some embodiments of the present disclosure.

With reference to FIG. 1, a portion of a carbon fiber reinforcement material 10 is shown. The material 10 comprises a plurality of longitudinal fiber bundles 100, transverse threads 105*a*, 105*b* and connecting threads 110*a*, 110*b*. The longitudinal fiber bundles 100 can be carbon fibers. The material 10 can be woven as illustrated in FIGS. 2-3. The weave can be a circular knit pattern that is known to be used to made elastic waistbands. A weaving machine such as, for example, the Jakob Mueller Rashelina RD3 may be set up to automate the weave to make the material 10.

In the weave pattern shown in FIG. 1, the longitudinal fiber bundles 100 are provided in parallel to one another with the transverse threads 105*a*, 105*b* provided in a continuously serpentine pattern with one serpentine thread pattern 105*a* on a first side of the longitudinal fiber bundles 100 and a second serpentine thread pattern 105*b* overlaying a second side of the longitudinal fiber bundles 100 in identical fashion. The connecting threads 110*a*, 110*b* include two threads 110*a*, 110*b* for each longitudinal fiber bundle 100 with each connecting thread 110*a* diagonally crossing the transverse threads 105*a* as they cross over the longitudinal fiber bundles 100, as illustrated in FIG. 2. The connecting threads 110*a* continually cross over the transverse threads 105*a* on a single side of the woven material 10 while the connecting threads 110*b* continually cross over the transverse threads 105*b* on the opposite side of the woven material 10. In between each transverse thread 105*a*, 105*b*, the connecting threads 110*a*, 110*b* from each side of the woven material 10 cross over each other, as illustrated in the cross-section of FIGS. 3 and 3A, and return to diagonally cross over the subsequent transverse thread 105*a*, 105*b*. The weave pattern has finished edges on each side and can be made much more easily than prior art weave patterns which require long narrow strips to be cut from wide sheets. Other weave patterns for elastic waistbands may be used such as those described in U.S. Pat. Nos. 4,551,994; 5,882,749; 4,786,549; and 4,631,932. The woven material 10 is rigid in the longitudinal direction and in contrast, the elastic waistband is elastic (stretchable) in the longitudinal direction. The woven material 10 can be provided with open spaces 115 in the weave which allows an adhesive to flow through the woven material 10 when the material 10 is applied to a structure.

The woven material 10 can be rigidified. In some embodiments the material is rigidified and cut into strips that are from abut 7 feet to about 12 feet in length. Such lengths are useful for applying the material 10 to basement walls. The rigidification of fiber material includes coating the material in epoxy that is procured as described in commonly assigned U.S. Pat. Nos. 6,846,537; 6,746,741; and 6,692,595, each of which is herein incorporated by reference in their entirety. The application of a material to repair a crack in a basement wall are described in the above mentioned patents and is applicable to the woven material 10 described herein.

In some embodiments, the longitudinal fibers 100 and transverse threads 105*a*. 105*b* may be spaced anywhere from over 1 inch apart to less than 1/32 inches apart so long as the open spacing 115 is sufficient to allow adhesive to flow between the fibers bundles 100 and transverse threads 105*a*, 105*b*. The material 10 has a roughened surface exposed or produced upon removal of a cover sheet applied during the rigidification process. In some embodiments, the longitudinal fibers 100 are made of pre-cured carbon, although any material providing flexibility and tensional strength may be used. Moreover, longitudinal fibers 100 and transverse threads 105*a*, 105*b* may be of different materials. For example, longitudinal fibers 100 may be Kevlar or bundles of Kevlar and transverse threads 105*a*, 105*b* may be a nylon or a nylon blend. Other examples of longitudinal fibers 100 include carbon fibers, poly-parapheneylene tetraphthalamide, para-aramid nylon, aramid fiber, aromatic polyamide, and combinations thereof. In some embodiments, longitudinal fibers can be in bundles or individual fibers. Other examples of transverse threads 105*a*, 105*b* can include nylon, polyester, polypropylene, nomex, cotton, carbon fibers, poly-parapheneylene tetraphthalamide, para-aramid nylon, aramid fiber, aromatic polyamide, and combinations thereof.

As discussed herein, to provide a strong bond between the rigidified fiber woven material 10, it is important to have the surface of the rigidified fiber woven material 10 clean and roughed. In order to keep the surface clean and provide a roughened surface, a flexible cover sheet of impermeable sheet or film comprising textile, nylon, a polymeric or plastic material is applied on one or both surfaces of the woven material using a rigidifying adhesive material.

At the job site, the cover sheet prevents dirt, grease and other debris from coming into contact with the woven material 10. Immediately prior to use, the cover sheet(s) is (are) removed, or more accurately peeled away, from the surface of the material 10 leaving exposed a clean roughened surface. This roughened surface is a result of at least two factors, individually or in combination. First, the textured surface of the cover sheet causes an impression to be formed in the adhesive material on the surface as it cures. Second, as the cover sheet is removed from the material 10, some of the adhesive material remains adhered to the cover sheet and breaks away from the material 10.

The embodiments and examples described herein are exemplary and not intended to be limiting in describing the full scope of devices, apparatus, systems, and methods of the present disclosure. Equivalent changes, modifications and variations of the embodiments, materials, compositions and methods can be made within the scope of the present disclosure, with substantially similar results. All patents discussed herein are incorporated by reference.

The invention claimed is:

1. A method of making a rigidified fiber reinforcement material, comprising the steps of:

providing a plurality of longitudinal fiber bundles extending generally parallel to one another in a longitudinal direction and spaced laterally from one another by at least 1/32 of an inch, said plurality of longitudinal fiber bundles being made from individual strands of fibers bundled together and selected from the group consisting of carbon fibers, poly-parapheneylene tetraphthalamide, para-aramid nylon, aromatic polyamide and combinations thereof;

knitting a transverse fiber bundle extending in a continuous serpentine pattern across each of said plurality of longitudinal fiber bundles only on a first side of said plurality of longitudinal fiber bundles with a plurality of pairs of connecting threads, each of said pairs of connecting threads corresponding to each one of said plurality of longitudinal fiber bundles, each of said plurality of pairs of connecting threads including a first thread diagonally crossing the transverse fiber bundle at each crossover point where said transverse fiber bundle crosses over said longitudinal fiber bundle and being repeatedly interlaced with a second thread of the pair of threads on opposite sides of the longitudinal fiber bundles in an alternating manner on opposite sides of each crossover point for securing said transverse fiber bundle to a respective one of said plurality of longitudinal fiber bundles at each crossover point at a plurality of longitudinally spaced locations to form a knitted material;

coating said knitted material in epoxy; and curing the epoxy to rigidify the knitted material to form the rigidified fiber reinforcement material.

2. The method according to claim 1, wherein said transverse fiber bundle is selected from the group consisting of nylon, nylon blend, polyester, polypropylene, nomex, cotton, carbon fibers, poly parapheneylene tetraphthalamide, para-aramid nylon, aramid fiber, aromatic polyamide, and combinations thereof.

* * * * *